US006344002B1

(12) United States Patent
Kajita

(10) Patent No.: US 6,344,002 B1
(45) Date of Patent: Feb. 5, 2002

(54) WOOD CLUB HEAD

(75) Inventor: Ryota Kajita, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/396,447

(22) Filed: Sep. 15, 1999

(30) Foreign Application Priority Data

Sep. 16, 1998 (JP) ..... 10-261992

(51) Int. Cl.[7] ..... A63B 53/04
(52) U.S. Cl. ..... 473/330; 473/345; 473/349
(58) Field of Search ..... 473/324, 331, 473/330, 349, 131, 290, 291, 345, 346, 350

(56) References Cited

U.S. PATENT DOCUMENTS 1,657,473 A * 1/1928 Howard
2,395,837 A * 3/1946 Baymiller
3,625,518 A * 12/1971 Solheim
3,989,257 A * 11/1976 Barr
4,367,878 A * 1/1983 Schmidt
4,471,961 A * 9/1984 Masghati
4,521,022 A * 6/1985 Schmidt
4,725,062 A * 2/1988 Kinney
4,840,380 A * 6/1989 Kajita
5,028,049 A * 7/1991 McKeighen
5,141,231 A * 8/1992 Cox
5,310,185 A * 5/1994 Viollaz
5,382,019 A * 1/1995 Sneed
5,415,405 A * 5/1995 Vincent
5,681,228 A * 10/1997 Mikame

* cited by examiner

*Primary Examiner*—Sebastiano Passaniti
(74) *Attorney, Agent, or Firm*—Sughrue Mion, PLLC

(57) ABSTRACT

In a wood club head having a face 2 constituted by convex surfaces curved vertically and horizontally, a bulge radius forming the substantially horizontally-curved surface is set to be not smaller than 15 inches.

2 Claims, 4 Drawing Sheets

WOOD CLUB HEAD

BACKGROUND OF THE INVENTION

1. Field of the Invention

The present invention relates to a wood club head having a face constituted by convex surfaces curved vertically and horizontally, and particularly to a wood club head having a devised face.

2. Description of the Related Art

In the background art, the face of a wood club head acting as a hitting surface is constituted by vertically and horizontally curved surfaces each having a radius of about 10 inches. The vertically and horizontally curved surfaces are called a roll and bulge respectively. Assume the case that hitting occurs when a face 2 of a head 1 is perpendicular to a target. In this case, if the face 2 is formed to be a flat surface as shown in FIG. 6, and if a ball B is hit at a sweet spot S of the face 2, which is an intersecting point between the face 2 and a perpendicular drawn from the center of gravity to the face 2, the ball B will be hit substantially straight toward the target. If the ball B is hit a little to a heel 3 side of the face 2 off of the sweet spot S, however, the head 1 swings counterclockwise around the center of gravity to thereby make the ball B1 rotate clockwise (slice spin) as shown by the ball B1 in FIG. 7. On the contrary, if the ball B is hit a little to a toe 4 side of the face 2, the head swings clockwise around the center of gravity to thereby make the ball B rotate counterclockwise (hook spin) as shown by the ball B2 in FIG. 7. Generally, such a spin generation effect is called a gear effect. That is, when a ball is hit a little to the right or to the left off the sweet spot S of the face 2, the ball is subjected to a slice or hook spin so that the ball is made to fly missing the target direction largely to the right or left and the directivity of the hit ball is remarkably reduced. To eliminate such a disadvantage, therefore, the face 2 is formed into a curved surface. Since the balls B1 and B2 fly out in the direction of the normal of the curved surface when a horizontally-curved surface is formed as the face 2 as shown in FIG. 8 even when the ball is hit a little off of the sweet spot S, the foregoing gear effect is canceled so that the directivity of the ball is improved. Further, such a phenomenon is generated also in the case where the ball is hit a little to the up or down side off the sweet spot S. In this case, the direction of hitting the ball is corrected by a so-called roll radius forming a vertically-curved surface and the flight distance of the hit ball is increased in place of the foregoing directivity of the ball. The horizontal bulge radius has been empirically selected to be about 10 inches for about ten years or more since a persimmon tree was selected to be used as a material of a head.

Recently, as the material of a wood club, however, titanium or an alloy thereof, which is a metal material having low specific gravity, high hardness, and high strength, has been frequently utilized, and the size of a head and the length of a club shaft have been increased. As a result, the inertial moment of the head is increased (for example, the value is increased from 10–20 g·mm·sec$^2$ in the case of a persimmon head to 20 g·mm·sec$^2$ or more in the case of a so-called metal head) so that, even in the case where a ball is hit at a portion a little off the center, that is, at a portion off the sweet spot S, a head is suppressed from swinging around the center of gravity and generation of the foregoing gear effect is reduced. As a result, there arises a problem that the value of the bulge radius which has been empirically taken into confidence is made unsuitable.

SUMMARY OF THE INVENTION

In order to eliminate the foregoing disadvantage, an object of the present invention is to provide a wood club head having a bulge radius which is suitable for a large and hollow head.

In order to achieve the above object, according to the present invention, there is provided a wood club head having a face constituted by convex surfaces curved vertically and horizontally, wherein a bulge radius forming the substantially horizontally-curved surface is set to be not smaller than 15 inches.

DETAILED DESCRIPTION OF THE PREFERRED EMBODIMENTS

A preferred embodiment of the present invention will be described below with reference to the accompanied drawings.

Figure 1:
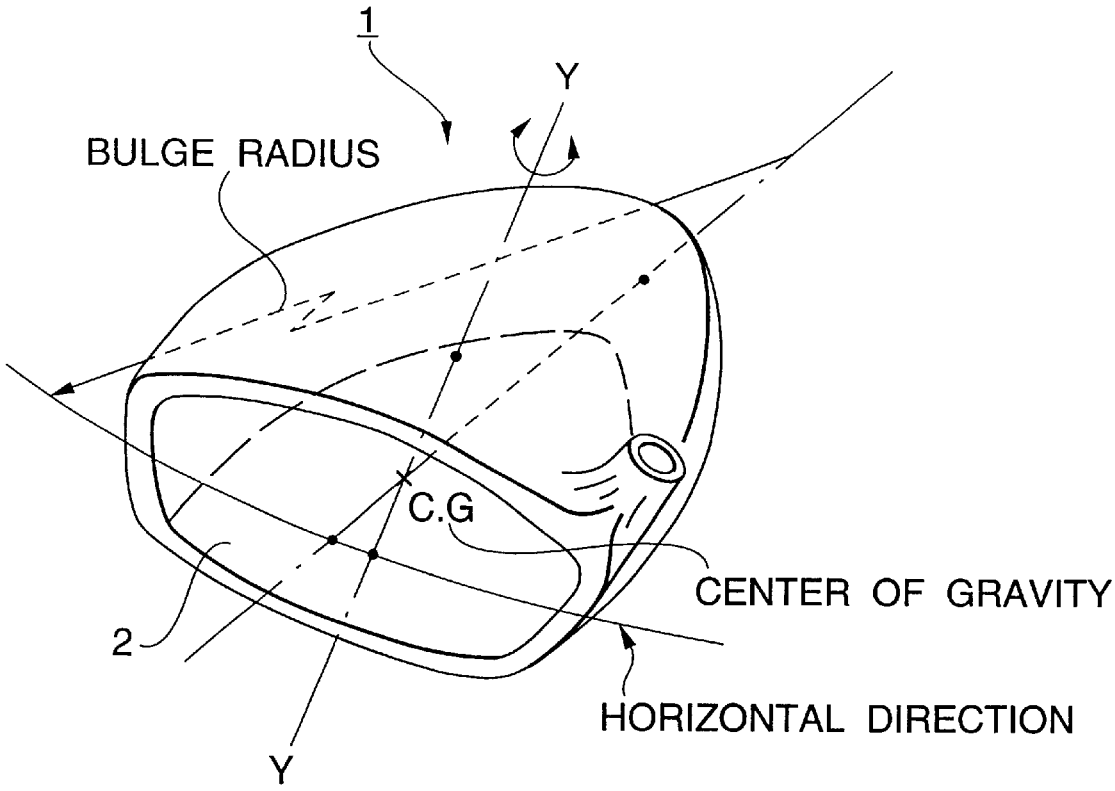
FIG. 1 is a perspective view of a head.
Figure 2:
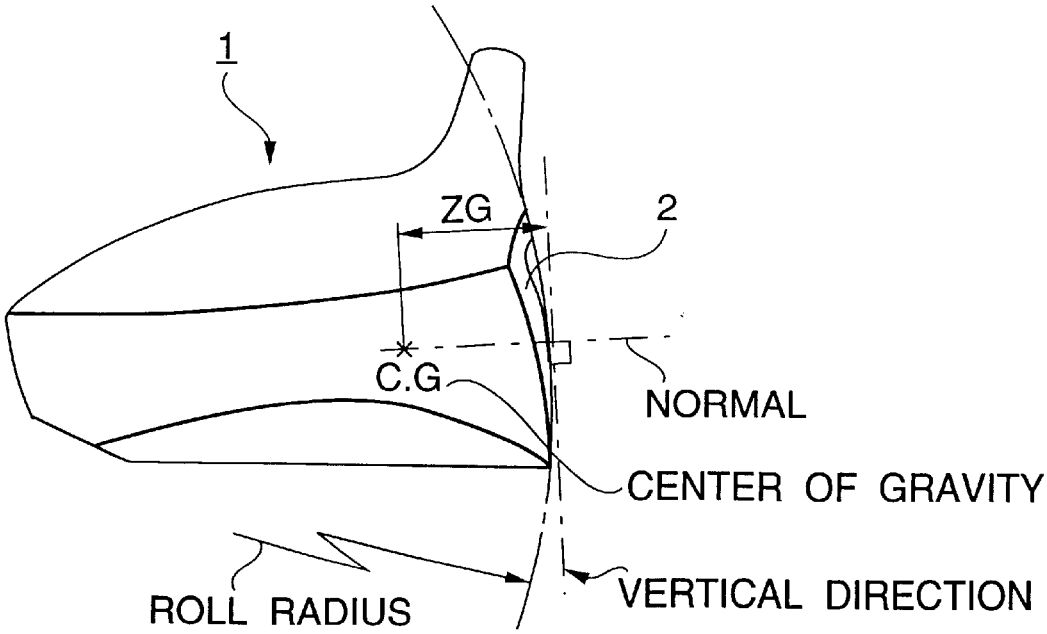
FIG. 2 is a side view of the head.
Figure 3:
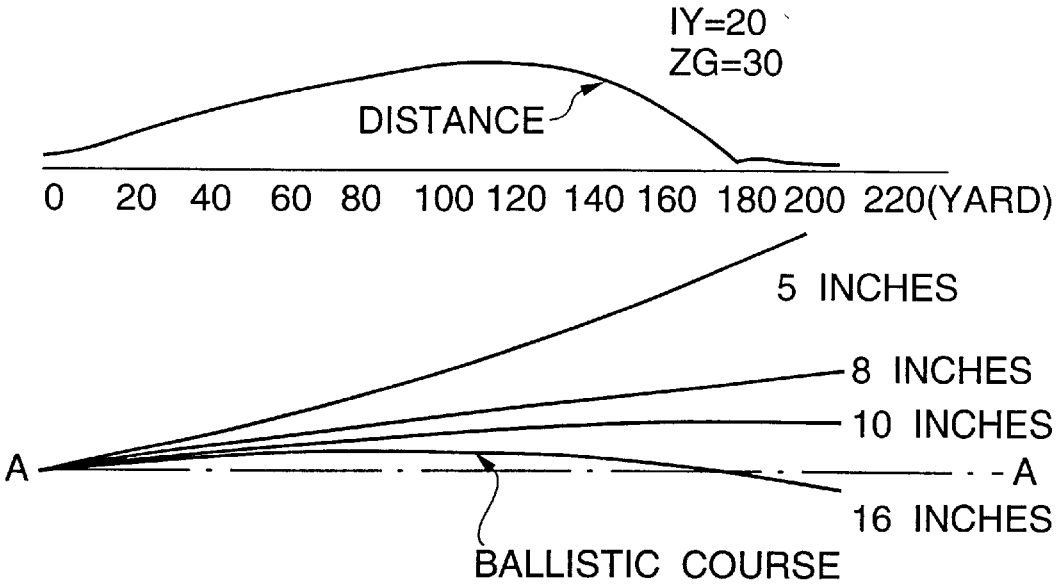
FIG. 3 is a graph showing variations in ballistic course due to bulge radii.

When the structures of golf club heads are compared with each other from the point of view of the gear effect with respect to the inertial moment (IY) around a vertical axis Y passing through the center of gravity of a head 1 and gravity depth (ZG) of the head 1 shown in FIGS. 1 and 2, it is found that IY>20 g·mm·sec$^2$ and ZG=20–35 mm in most of recently-used metal heads while IY=10–20 g·mm·sec$^2$ and ZG=20–30 mm in a conventionally used persimmon head (wood of No.1–No.5). Generally, in an iron club head, IY=20–35 g·mm·sec$^2$ and ZG=0–5 mm. In order to set the bulge radius in accordance with the difference in structure of a head, that is, in accordance which a change in degree of the gear effect due to the difference in inertial moment (IY) and gravity depth (ZG) in the present invention, the directivity of a hit ball in the case where the bulge radius of each of club heads different in IY and ZG was changed in the range of from 5 to 40 inches was evaluated on the basis of simulation by a computer by using the program of "impact and ballistic course calculation" developed by the present Applicant. FIG. 3 shows, as an embodiment, a part of the results. FIG. 3 shows ballistic courses in the case of using heads having IY=20 g·mm·sec$^2$ and ZG=30 mm and having the bulge radii of the face 2 of 5, 8, 10, and 16 inches which were made on the basis of the head specifications of the large and hollow driver of Tourstage Z-100 produced by our company and having a titanium alloy head of a volume of 255 cc. In this case, a ball was hit (by a right-handed person) at a head speed of 45 m/s and at a position apart by 10 mm from the sweet spot to the heel side.

In FIG. 3, since hitting is performed in the condition of off-center to the heel side by 10 mm, the ballistic course is corrected so as to be curved up in the drawing by application of the bulge radius forming the horizontally-curved surface of the face 2; otherwise the ballistic course becomes a slice-type ballistic course which will be curved down in the drawing because of the gear effect. Next, a displacement (m)

from a ballistic course (a line A—A in FIG. 3) directed straight toward a target to the falling point of a ball is measured to thereby obtain the bulge radius where the displacement of the falling point is zero is calculated. Then, the bulge radius is substantially 15 inches as shown in Table 1. That is, in the large and hollow metal head (IY=20, ZG=30) in this embodiment, it is found that the bulge radius for making a ball fly straight while the gear effect generated at the time of off-center hitting is canceled is 15 inches.

TABLE 1

| Displacement of falling point (m) | Bulge radius (inch) |
|---|---|
| −26.6 | 5 |
| −11.4 | 8 |
| −6.3 | 10 |
| 0.6 | 16 |

Further, in this embodiment, in order to examine the influence of the head speed, the displacement of the falling point was measured under the condition that the bulge radius was fixed into 15 inches and the head speed was changed in the range of from 30 to 50 m/s. It is assumed that there is no significant difference among the displacements so that the setting of the bulge radius does not depend on the head speed.

Figure 4:
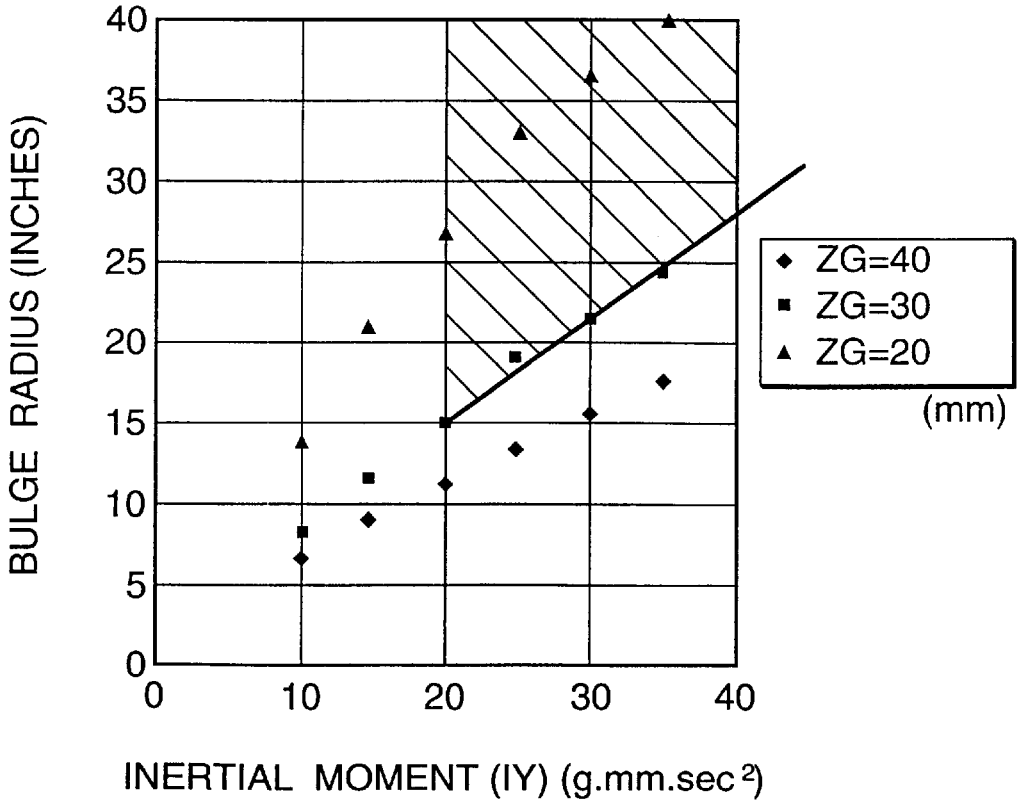
FIG. 4 is a graph showing a correlation between the bulge radius and IY and ZG.

Next, when the bulge radius corresponding to the gear effect of the head in the case where the inertial moment (IY) and the gravity depth (ZG) are changed within the ranges of from 10 to 35 g·mm·sec$^2$ and from 15 to 40 mm respectively which are considered to be the limit value for production of a large and hollow metal head are obtained in the same manner as in the simulation evaluation of FIG. 3, a correlation between the bulge radius and IY and ZG as shown in FIG. 4 is obtained.

It is found from the correlation that the inertial moment (IY) and the gravity depth (ZG) of a large and hollow metal head are empirically within a range of IY≧20 and ZG≦30 in practical use (a slanted portion in FIG. 4) so that the bulge radius of the face 2 is required to be set to be not smaller than about 15 inches in order to cancel the gear effect caused by off-center hitting by the head 1 having IY and ZG within the foregoing ranges substantially perfectly. Therefore, the bulge radius of the wood club head according to the present invention is set to be not smaller than 15 inches.

Figure 5:
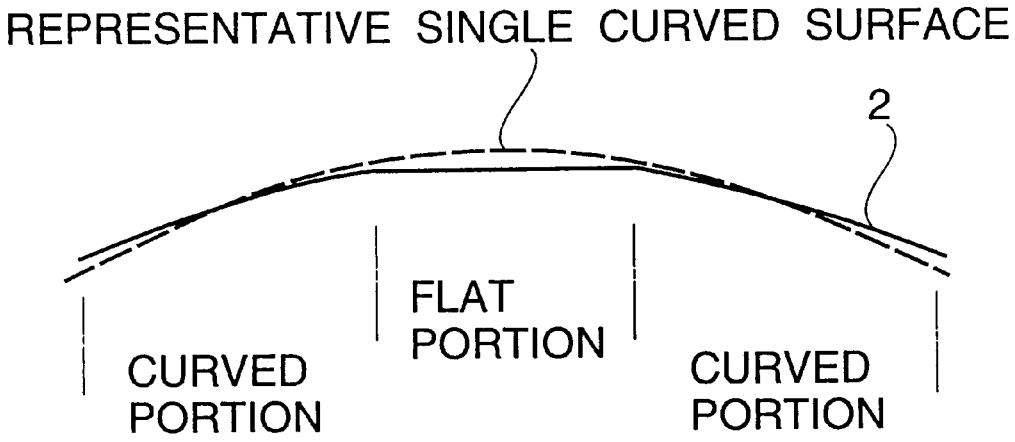
FIG. 5 is a view for explaining a substantially horizontally-curved surface of a face.
Figure 6:
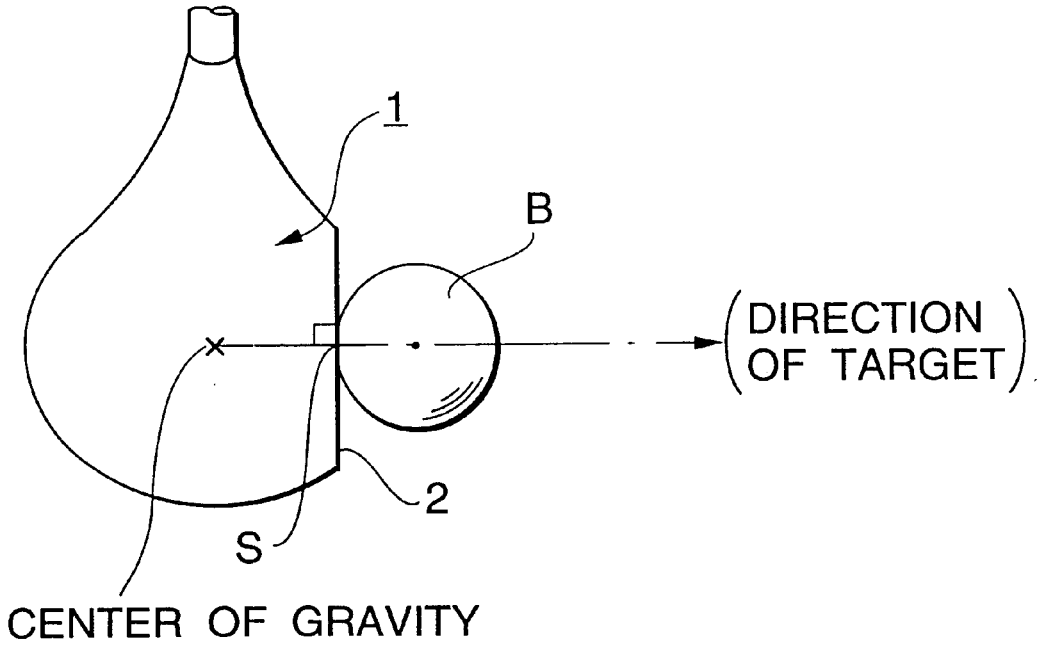
FIG. 6 is a view showing the state where a ball is hit at a sweet spot when a face is constituted by a flat surface.
Figure 7:
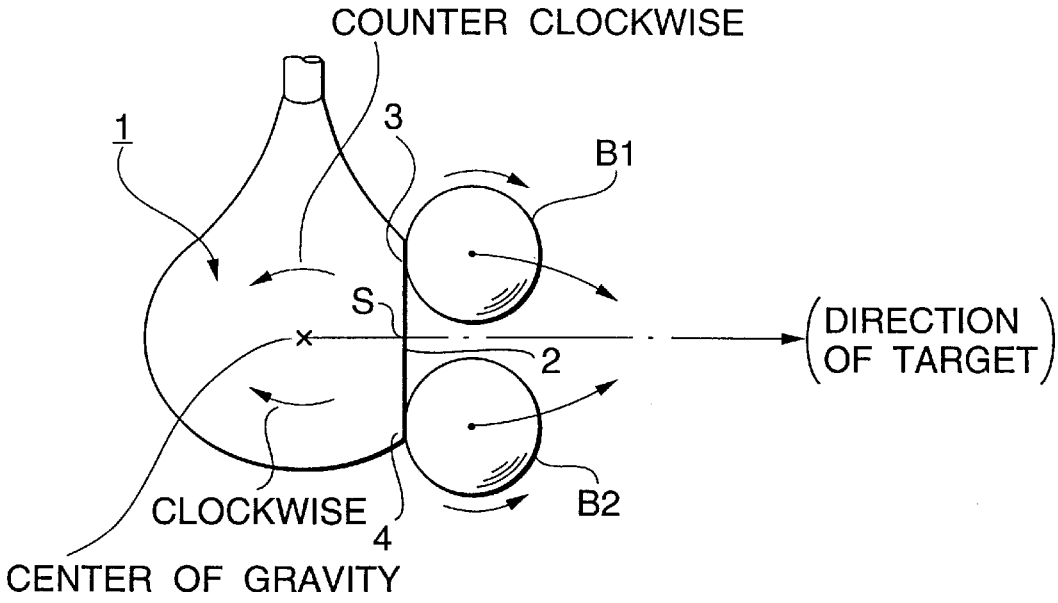
FIG. 7 is a view showing the state where a ball is hit at the portions on the heel and toe sides of the face shown in FIG. 6.
Figure 8:
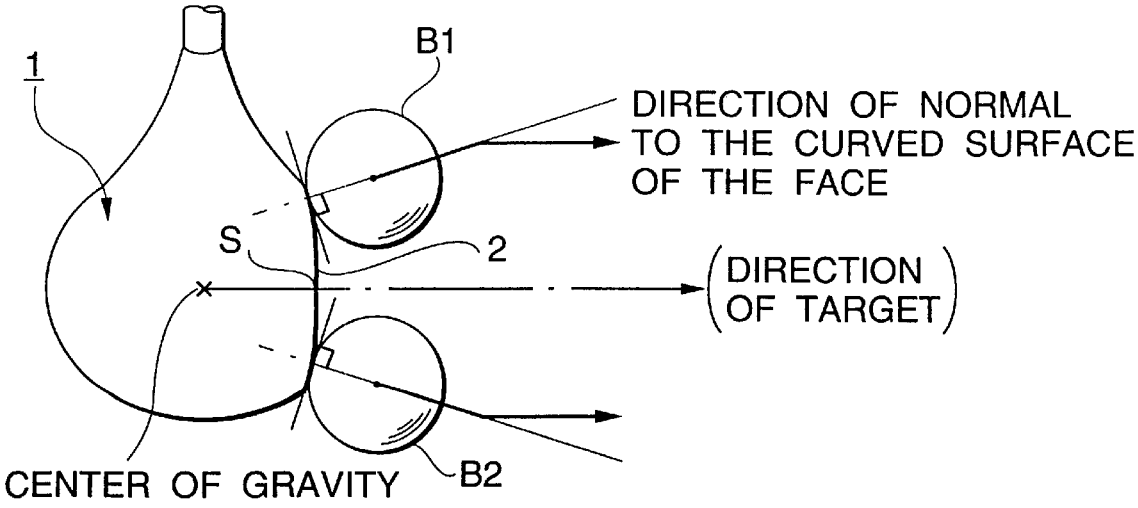
FIG. 8 is a view showing a state of off-center hitting in the case where a bulge and a roll radius are given to the face.

Further, when a horizontal portion of the face 2 is constituted not by a single curved surface but by a plurality of curved surfaces different in radius, or partially including flat surfaces, the substantially horizontally-curved surface of the face 2 according to the present invention means a single surface (FIG. 5) which represents on average such a plurality of curved surfaces having different radii and such flat surfaces. Moreover, the bulge radius at a position a little above/below the center of the face 2 (the point of ½height of the face) is formed from an arc taking the roll radius into consideration on the basis of the bulge radius passing through the center, by an ordinary construction method. Moreover, the substantially hollow structure of a head includes a structure in which a light filler such as sponge or the like is filled in the inside of a hollow and shell-like head.

As described above, according to the present invention, in a wood club head having a face constituted by convex surfaces curved vertically and horizontally, a bulge radius forming the substantially horizontally-curved surface is set to be not smaller than 15 inches. Accordingly, it is possible to improve the directivity of a ball even when the ball is hit at a position a little off the center of the face. Particularly, with respect to a club head in which the inertial moment (IY) around the vertical axis (Y) passing through the center of gravity of the club head is set to be large (not smaller than 20 g·mm·sec$^2$) and the distance of the perpendicular drawn from the center of gravity of the head to a face (that is, the gravity depth) is set to be short (not larger than 30 mm), in the case where a horizontally-curved surface of the face is formed with the most suitable bulge radius corresponding to the degree of the gear effect which will be generated when a ball is hit at a position a little off the center, for example, with respect to a large and hollow head using light and high-strength material, the inertial moment (IY) around the vertical axis (Y) passing through the center of gravity of the head becomes large and the gravity depth of the head becomes short. When a ball is hit at a position a little off the center by using such a head, therefore, the degree of the gear effect is considerably reduced. Accordingly, the horizontally-curved surface for canceling this gear effect may be a gentle one. Therefore, the bulge radius is selected to be a relatively large value. According to the present invention, therefore, it is possible to set the bulge radius corresponding to the degree of the gear effect based on the change of the head structure, and particularly, in a large and substantially hollow head, the directivity of a hit ball is extremely improved.

What is claimed is:

1. A wood club head formed of titanium alloy and having a substantially hollow structure filled with a light sponge filler, wherein an inertial movement (IY) around a vertical axis (Y) passing through a center of gravity of said wood club head is set to be not smaller than 20 g·mm·sec$^2$ and a distance (ZG) perpendicular from said center of gravity to said face is set to be not larger than 30 mm;

wherein the bulge radius (R) is set to a value in a range of not smaller than 15 inches, at which the amount of displacement of a ball falling point with respect to a target direction becomes substantially zero, the value of the bulge radius (R) is based on the inertial moment (IY) and the distance (ZG) of said perpendicular.

2. A wood club head formed of titanium alloy and having a hollow structure filled with a light sponge filler, said club head comprising a face constituted by convex surfaces curved vertically and horizontally wherein, a bulge radius forming the substantially horizontally-curved surface is set to be not smaller than 15 inches, inertial moment (IY) around a vertical axis (Y) passing through a center of gravity of said club head is set to be not smaller than 20 g mm sec$^{2,}$ *and* a distance (ZG) of a perpendicular drawn from said center of gravity to said face is set to be not larger than 30 mm.

* * * * *